US006846071B2

(12) United States Patent
Rhee

(10) Patent No.: US 6,846,071 B2
(45) Date of Patent: Jan. 25, 2005

(54) INK SUPPLY APPARATUS FOR INKJET PRINTER

(75) Inventor: Yeong-Won Rhee, Seoul (KR)

(73) Assignee: Hanlim Mechatronics, Co., Ltd., Seoul (KR)

( * ) Notice: Subject to any disclaimer, the term of this patent is extended or adjusted under 35 U.S.C. 154(b) by 12 days.

(21) Appl. No.: 10/470,449

(22) PCT Filed: Nov. 25, 2002

(86) PCT No.: PCT/KR02/02204

§ 371 (c)(1),
(2), (4) Date: Jul. 25, 2003

(87) PCT Pub. No.: WO03/076194

PCT Pub. Date: Sep. 18, 2003

(65) Prior Publication Data

US 2004/0046842 A1 Mar. 11, 2004

(30) Foreign Application Priority Data

Mar. 12, 2002 (KR) ..... 10-2002-0013102

(51) Int. Cl.[7] ..... B41J 2/175
(52) U.S. Cl. ..... 347/85
(58) Field of Search ..... 347/7, 84, 85, 347/86; 222/92, 372, 373, 400.5; 137/12, 115.02

(56) References Cited

U.S. PATENT DOCUMENTS

| | | | | |
|---|---|---|---|---|
| 4,383,263 A | | 5/1983 | Ozawa et al. | 370/30 |
| 4,432,005 A | | 2/1984 | Duffield et al. | 370/86 |
| 4,999,652 A | | 3/1991 | Chan | 370/86 |
| 5,136,309 A | * | 8/1992 | Iida et al. | 347/7 |
| 5,504,510 A | * | 4/1996 | Miyakawa | 347/85 |
| 6,059,405 A | * | 5/2000 | Mochizuki et al. | 347/92 |
| 6,183,073 B1 | * | 2/2001 | Rottman et al. | 347/85 |
| 6,267,474 B1 | * | 7/2001 | Mochizuki | 347/86 |

FOREIGN PATENT DOCUMENTS

JP 55-139268 A 10/1980

* cited by examiner

*Primary Examiner*—Anh T. N. Vo
(74) *Attorney, Agent, or Firm*—Mathews, Collins, Shepherd & McKay P.A.

(57) ABSTRACT

The present invention relates to an ink supply apparatus for an inkjet printer in which ink can continuously supplied to each cartridge of a large-scale inkjet printer. In the inkjet printer, since it is not necessary to replace the cartridge, it is very economical. Also, since ink is continuously and automatically supplied to each cartridge, the efficiency and workability can be improved.

4 Claims, 9 Drawing Sheets

INK SUPPLY APPARATUS FOR INKJET PRINTER

TECHNICAL FIELD

The present invention relates to an ink supply apparatus for large scale inkjet printer, and more particularly to an ink supply apparatus for large scale inkjet printer in which ink can be continuously and automatically supplied to a cartridge of the inkjet printer so as to fill the cartridge with ink, which does not need replacement of the cartridge thus to improve efficiency and workability of supplying the ink as well as to provide economical aspects.

BACKGROUND ART

As generally known in the art, a large scale inkjet printer has been essentially used in manufacturing various outdoor advertising sign, and recently, which is likely to have been further diversifying or scaling-up, so that it needs to continuously supply a great quantity of ink required for printing.

As shown in FIGS. 1 and 2, a simplified structure of the large scale inkjet printer comprises a printer body 1 having housings 3, each of which is supported by plural supporting legs 2 and in which a carriage bar is horizontally disposed between the housings; a printer head for printing a medium to be printed in an inkjet manner while horizontally moving across the carriage bar; and a cartridge assembly 4 that is mounted to one side of the back of the printer body and that has a plurality of cartridges for supplying ink to the printer head.

The cartridge assembly 4 has a plurality of cartridges 5, which are constituted so as to be placed in parallel, each storing ink including, for example, black, yellow, red or blue-green, etc.

The cartridge 5 in a unit includes a storing pack in which ink is filled, a casing of rectangular parallelepiped for protecting the storing pack, and an operating plate mounted to one side of the storing pack so as to inform of replacement time of the cartridge through a contact of a separate detecting switch upon exhaustion of ink.

Since the cartridge 5, however, is a disposable product, it must be detached from the printer and then replaced by a new cartridge when ink filled in the storing pack is exhausted.

The disposable cartridge 5 of the conventional structure, therefore, has a problem in that it is used to replace it by a new one every time, causing uneconomical aspects and poor workability of replacement of the cartridge 5.

That is, although ink is exhausted from even any one of the cartridges during printing, all operation of the printing must be interrupted, causing working time to be increased and workability thereof to be greatly reduced.

Especially, in the case where the cartridge 5 is replaced by a new one during printing, the printing is interrupted so that serious defects may be generated to the printed matter thus to make re-printing troublesome and expenses for printing considerably increased.

DISCLOSURE OF THE INVENTION

Therefore, the present invention has been made in view of the above-mentioned problems, and it is an object of the present invention to provide an ink supply apparatus for large scale inkjet printer, which can continuously supply ink to a cartridge, instead of replacing the cartridge, wherein ink is consumed in use, by a new one.

In order to accomplish this object, there is provided an ink supply apparatus for large scale inkjet printer, which is designed to be an ink-refill type apparatus, by which ink is continuously supplied to a cartridge insomuch as consumed in the cartridge in use, instead of a cartridge-replacement type apparatus, by which the used cartridge is replaced by a new one, so that economical merits are provided according to that the cartridge is not required to be replaced with a new one, and workability is increased with reduction of printing time by continuous printing.

BRIEF DESCRIPTION OF THE DRAWINGS

The foregoing and other objects, features and advantages of the present invention will become more apparent from the following detailed description when taken in conjunction with the accompanying drawings in which.

BEST MODE FOR CARRYING OUT THE INVENTION

Figure 1:
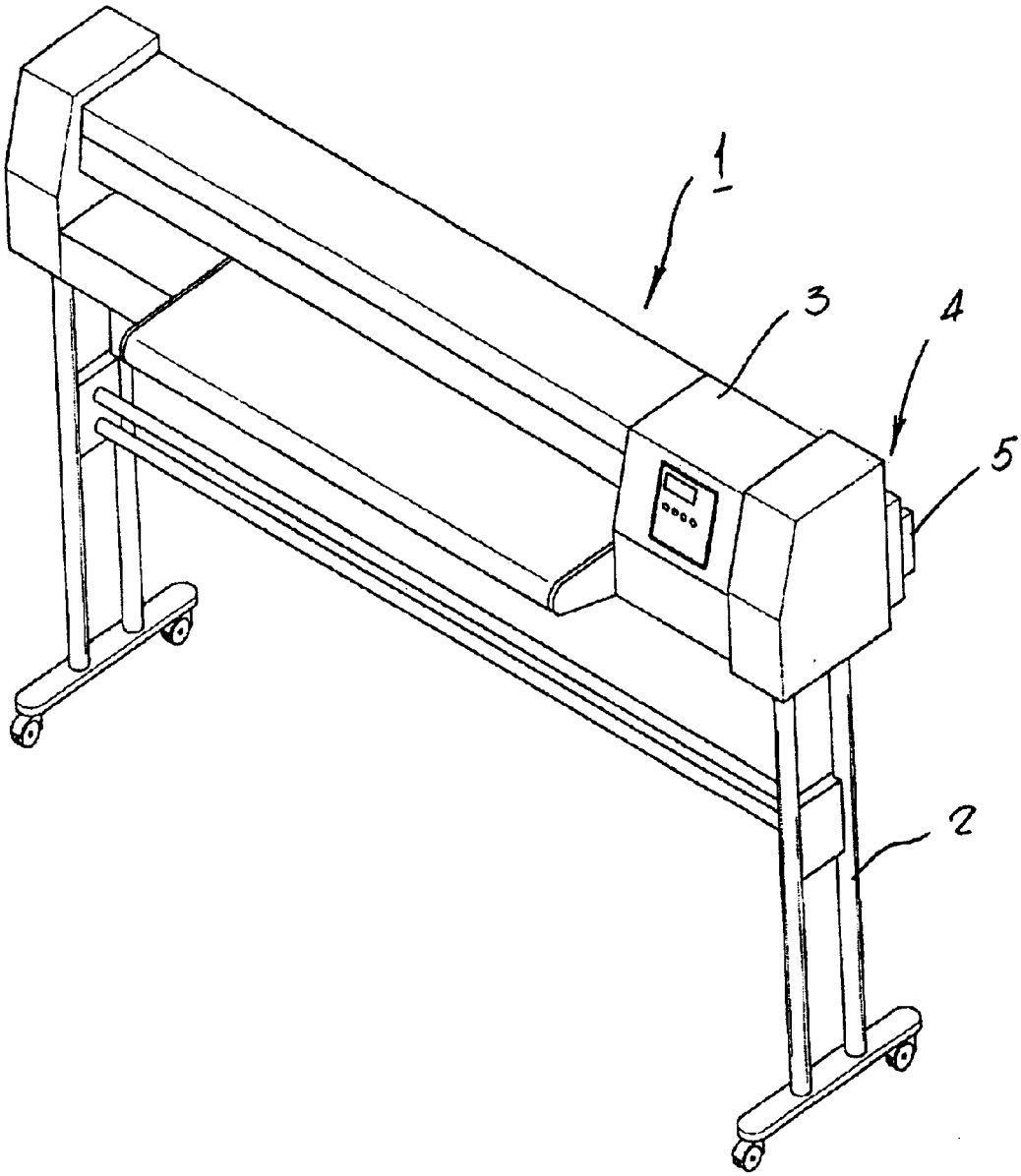
FIG. 1 is a schematic view of conventional large-scale inkjet printer.
Figure 2:
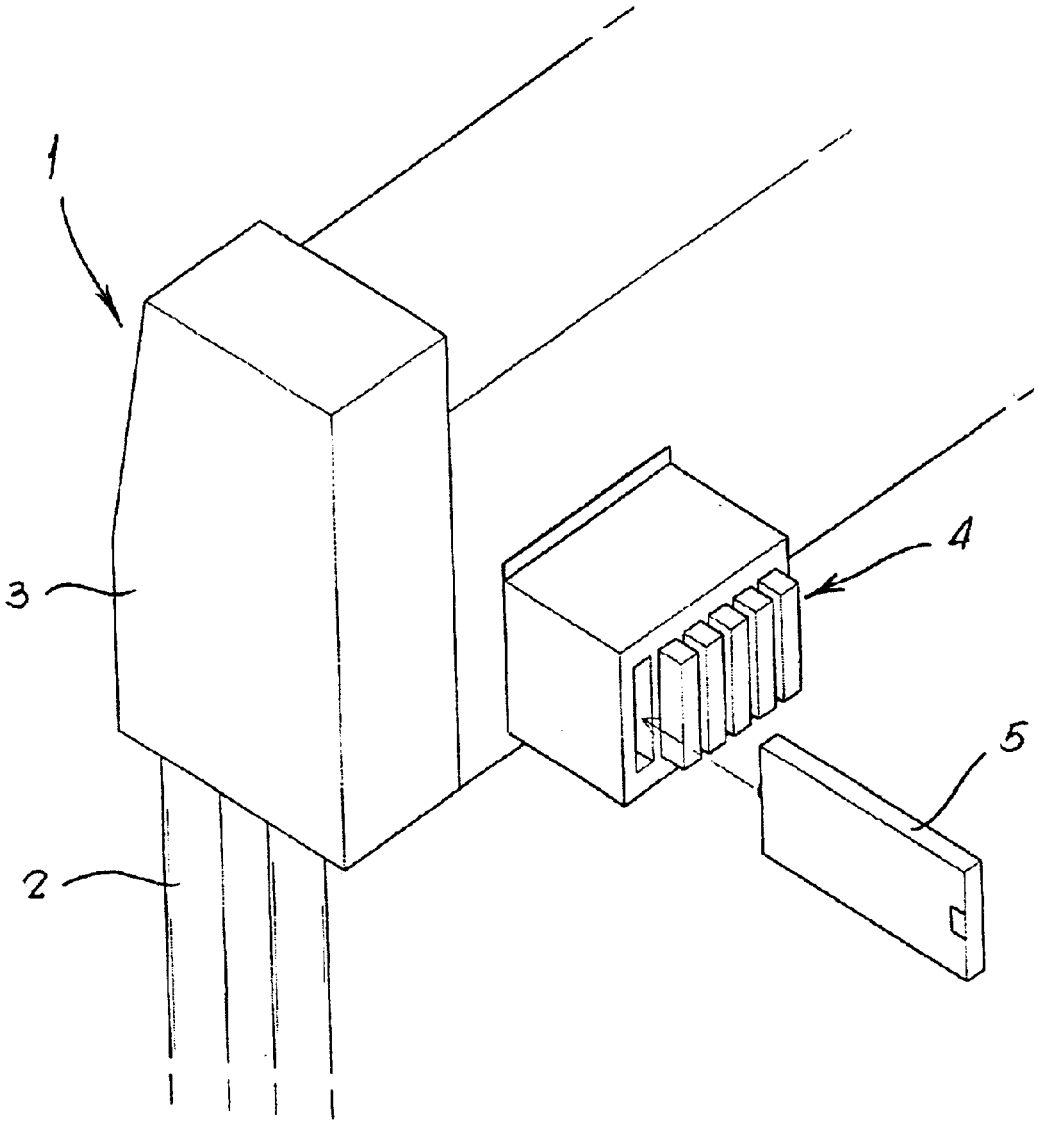
FIG. 2 is a partial perspective view of FIG. 1.
Figure 3:
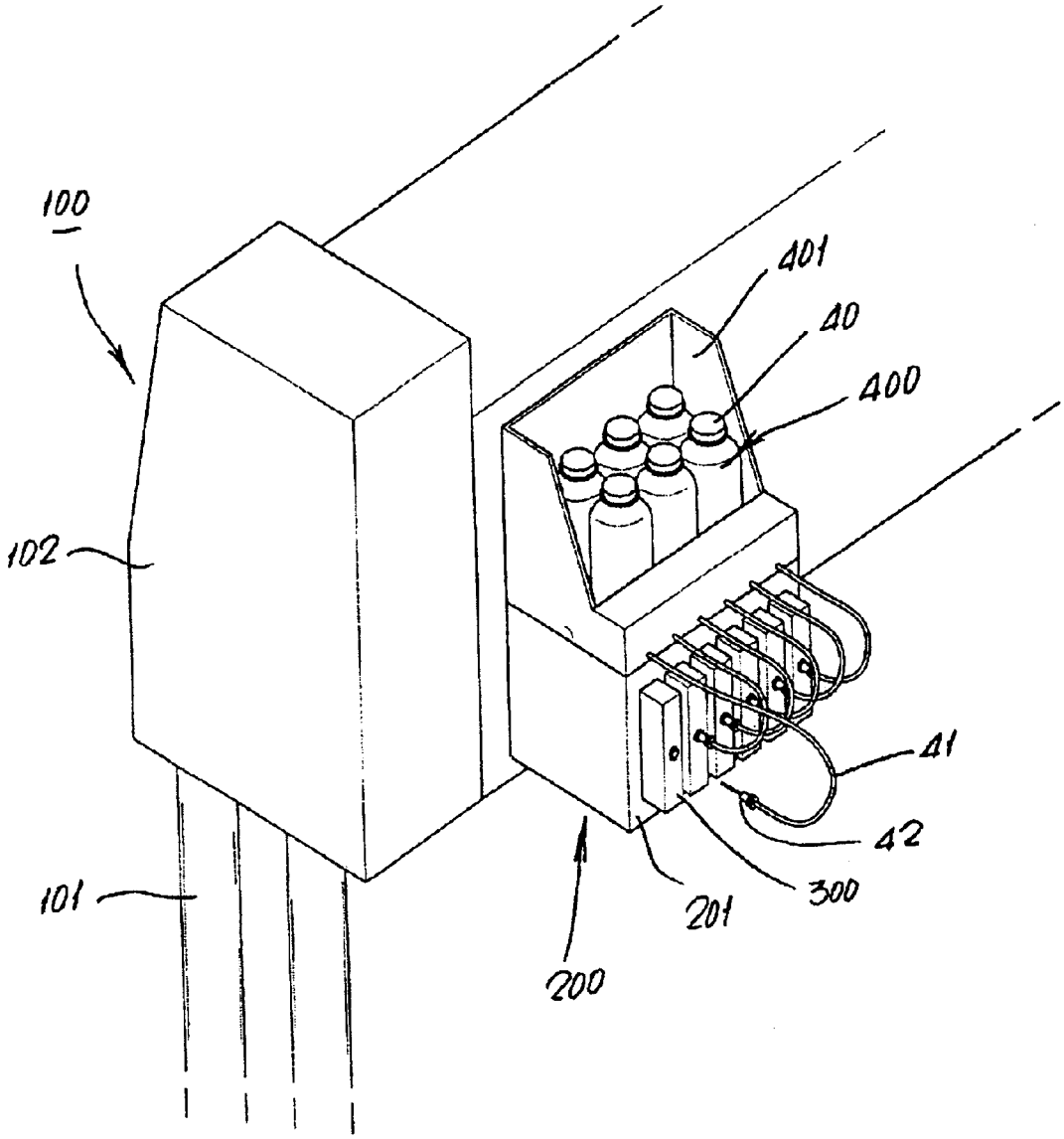
FIG. 3 is a partial perspective view of an inkjet printer according to the present invention.
Figure 4:
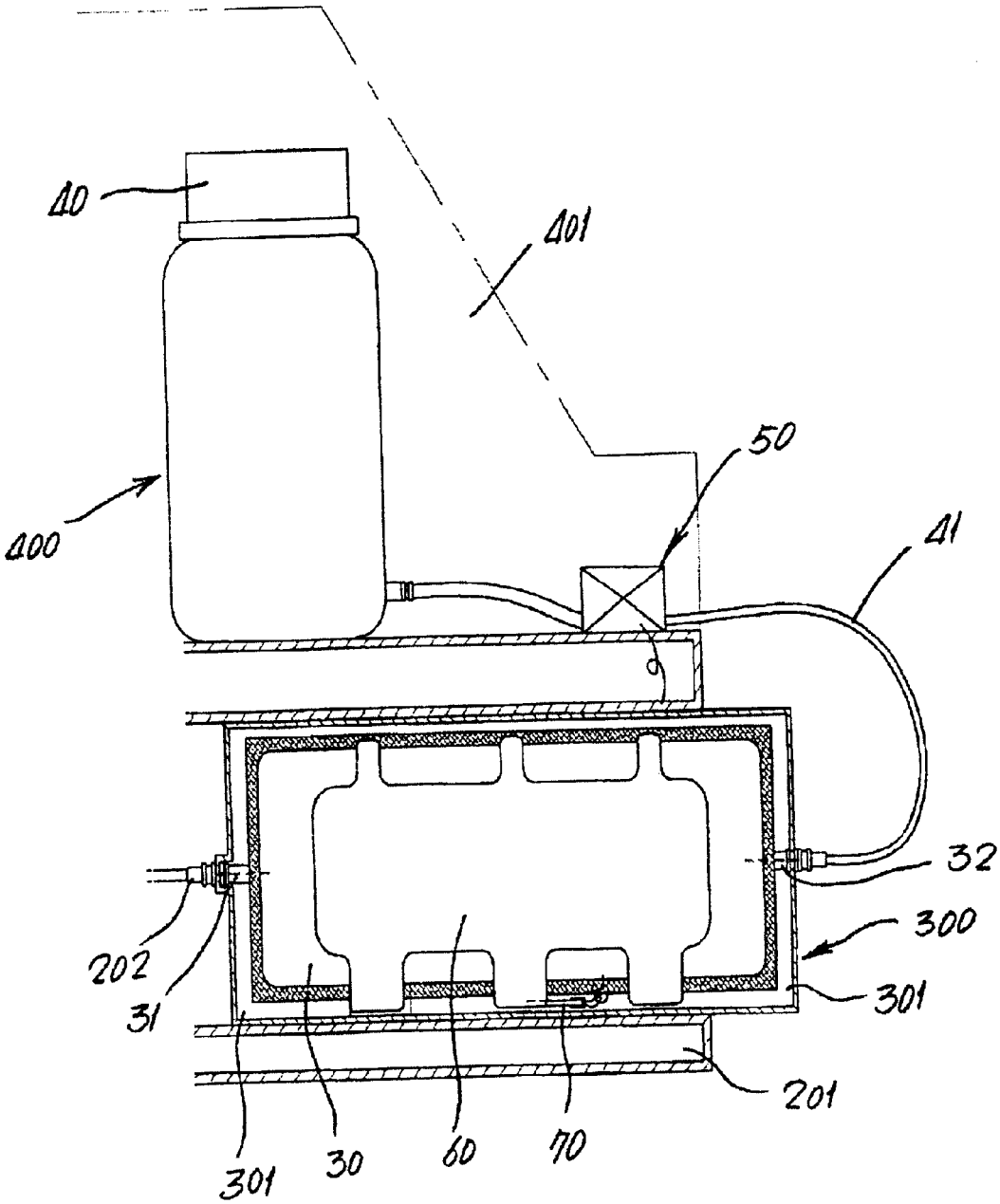
FIG. 4 is a side end view of FIG. 3.
Figure 5:
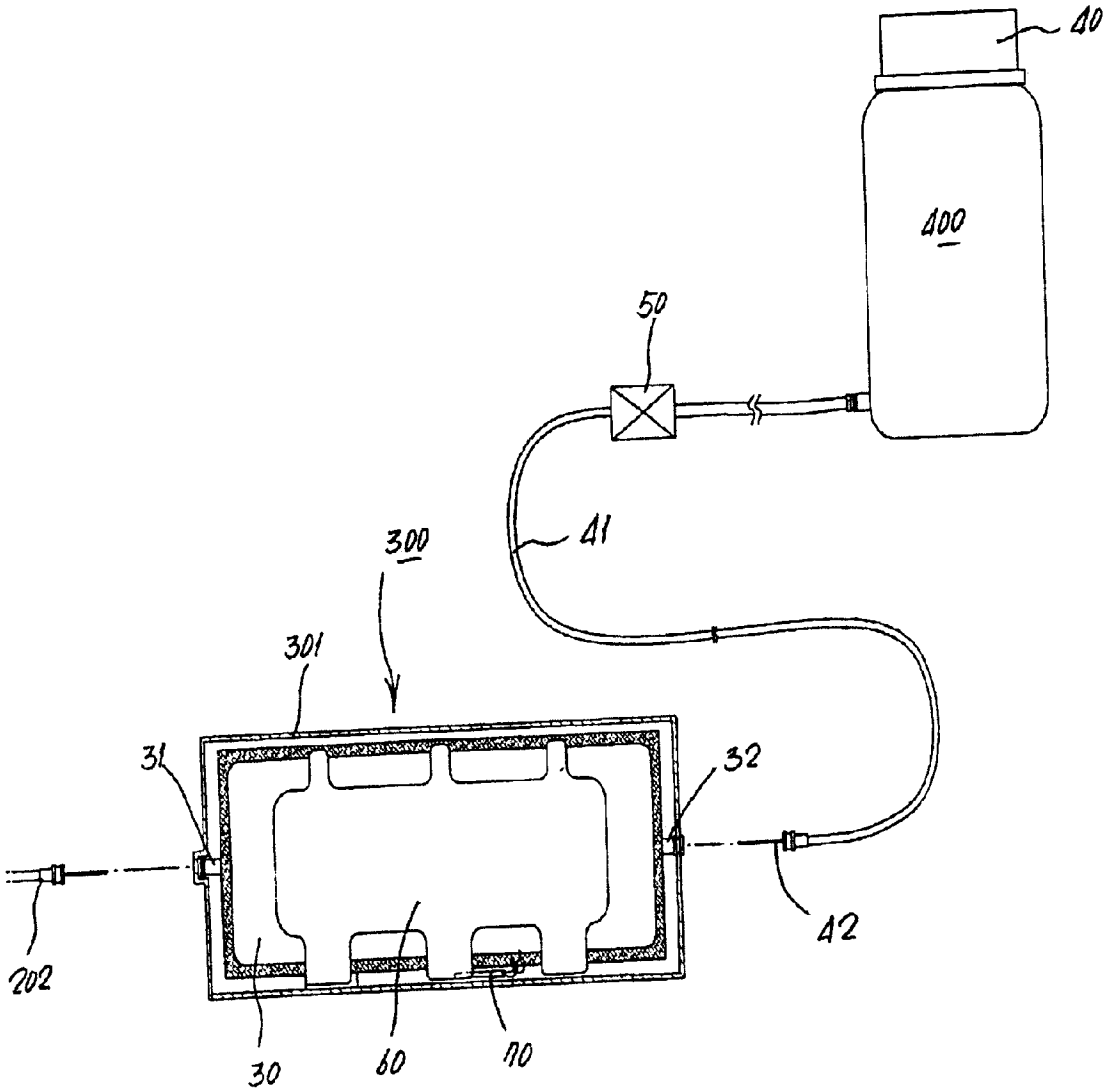
FIG. 5 is a partial view of FIG. 4, showing only major elements of the present invention.
Figure 6:
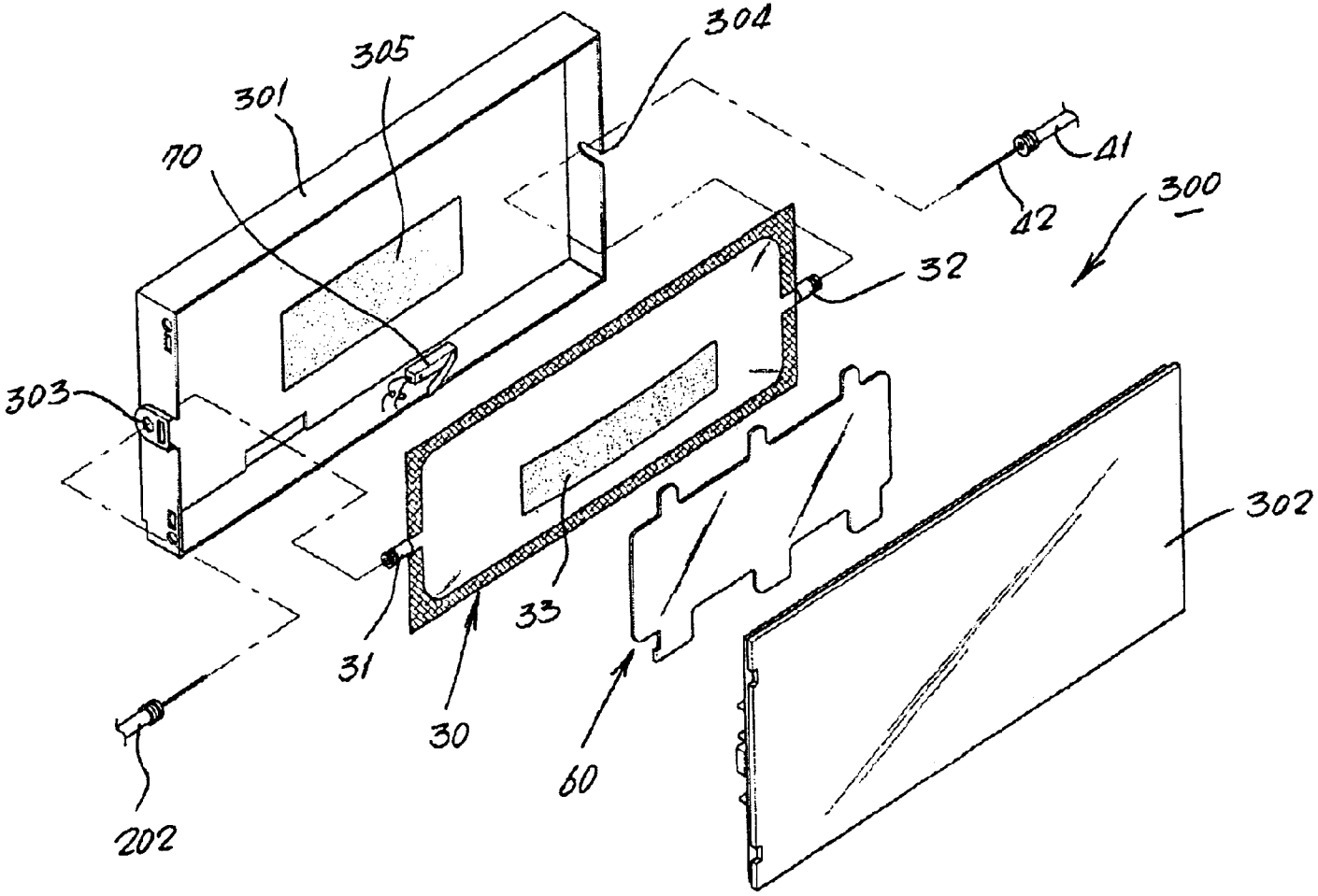
FIG. 6 is an exploded view of a cartridge shown in FIG. 5.

Reference will now be made in detail to the preferred embodiments of the present invention.

The present invention is adapted to a large-scale inkjet printer, one embodiment of which is shown in FIGS. 3 to 9 in which the reference numeral 100 indicates a body of the printer.

The inkjet printer includes a body 100 having a housing 102 supported by a plurality of supporting legs 101 and protected by a cover, the housing having a carriage bar, that is not shown in the drawings, therein, and a print head for printing an object to be printed while laterally moving across the carriage bar; and a cartridge assembly 200 installed to one side of the back of the body and having a plurality of cartridges 300 for supplying ink to the print head, the respective cartridges storing inks, respectively, in different colors like common cartridges.

The cartridge assembly 200 has slots 201 into which plural cartridges with different colors are inserted, respectively, so as to be mounted thereto. Inside the slots, a syringe-needle type connecting pipe 202 is coupled to the print head and an ink storage pack of the cartridge 300, which is described later, through a flexible connecting tube so as to supply ink to the print head.

Above-mentioned construction is similar to that of the conventional cartridge assembly. The present invention, however, includes an ink supply system for continuously supplying ink to the respective cartridges of the cartridge assembly described above, an embodiment of which is shown in detail in FIGS. 4 to 9.

The ink supply system of the present invention comprises cartridges 300 mounted to slots 201, respectively; and ink supply tanks 400 for continuously refilling the cartridges, respectively, with ink.

The cartridge 300 is constituted in such a way that a separate storage pack 30 containing a certain quantity of ink therein is mounted in a rectangular-parallelepiped case 301.

The storage pack 30 is made of flexible vinyl materials and contains a certain quantity of ink therein. The storage pack includes at front portion an ink outlet 31 for supplying ink stored in the storage pack to the print head through a connecting pipe 202 of the slot 201, and at rear portion an ink inlet 32 for supplying ink to the storage pack 30, the ink outlet and inlet being integrally formed onto the storage pack.

The ink outlet and inlet 31 and 32 are sealed with resilient materials such as silicon so as to prevent from penetration of air into the storage pack 30, and in use, the syringe-needle type connecting pipe 202 and supplying pipe are respectively inference-fitted to the outlet and inlet so as to supply ink inwards and outwards of the storage pack.

Additionally, an ink supply tank 400 is connected to the ink inlet 32 formed at the rear portion of the storage pack 30 so as to continuously supply ink by consumed amounts of ink stored in the storage pack. The ink supply tank is formed with a large vessel capable of storing ink through opening or closing of a cap 40.

Therefore, the ink supply tank is required to have large size sufficient to store supplying ink and it is preferably formed of transparent materials so as to check the amount of stored ink from time to time.

Meanwhile, in another embodiment of the ink tank, a separate air inflow controller 43 is provided on the cap 40 of the ink supply tank 400 in order to control the amount of supplying ink depending on the amount of air inflow.

That is, when the amount of air inflow is increased, the amount of supplying ink is also increased because exterior atmospheric pressure would be applied inside the ink supply tank 400, and on the contrary, when the air inflow is reduced, the supplying ink would be also reduced.

Also, the ink supply tank 400 is seated on a separate shelf 401 installed at rear portion of the body 100. The shelf 401 is constructed so as to safely seat and store a plurality of ink supply tanks 400 and to be mounted at a portion higher than that of the slots 201 in which the cartridges 300 are mounted.

Further, a flexible supplying tube 41 is connected to one side under the ink supply tank 400 so as to supply stored ink to the ink storage pack 30 of the cartridge 300. A syringe-needle type supplying pipe 42 is integrally formed at an end portion of the supplying tube 41 as to be inference-fitted to the ink inlet 32 of the storage pack 30.

The supplying pipe 42 serves as a connecting nipple that is inference-fitted to the ink inlet 32 of the storage pack 30 so as to connect the supplying tube and the storage pack with each other.

Meanwhile, although the above-mentioned construction is designed so that the storage pack 30 of the cartridge 300 and the ink supply tank 400 are connected together by the supplying tube 41 through the syringe-needle type supplying pipe 42, another embodiment of the construction, which is not shown in the drawings, can be provided so that the supplying tube 41 is integrally formed to the storage pack 30.

The supplying tube 41 serves to provide a passage for smoothly supplying ink stored in the ink supply tank 400 to the storage pack 30 of the cartridge 300, and in order to open and close the passage, a solenoid valve 50 is provided at a certain position of the supplying tube.

The solenoid valve 50 is turned on and off so as to open and close the passage of the supplying tube 41, functioning supply or shut-off of ink in the ink supply tank 400 to the storage pack 30.

In this case, since the ink supply tank 400 is designed as to be mounted to a portion higher than that of at least the storage pack 30, ink stored in the ink supply tank 400 can be smoothly and continuously supplied to the storage pack 30.

Meanwhile, as another embodiment of the present invention, a control valve 51 is provided on the supplying tube 41 so as to control the amount of supplying ink.

The control valve 51 is operated to be opened and closed by a control lever thus to precisely control the amount of ink passing through the supplying tube 41, the operation of the control valve being possibly associated with that of the air inflow control valve 43 mounted on the cap 40 of the ink supply tank 400 as described above.

Further, in order to protect the storage pack 30, the case 301 is provided, which is formed with the rectangular parallelepiped having same size and shape as common cartridge so that it may be releasably assembled by a cover 302, and which has, at front and back faces, coupling holes 303 and 304, respectively, possibly fitted to the ink outlet and inlet 31 and 32 of the storage pack 30, respectively.

Also, an adhesive face 305 is formed on an inner face of the case 301 so as to securely fix the storage pack 30 as not to be moved. An operating plate 60 is provided in close proximity to one side of the storage pack 30 so as to adhere to an adhesive face 33 of the storage pack, thus being operated depending on the amount of ink stored in the storage pack 30.

Since the operating plate 60 is formed with a plate type member and adheres to the surface of the storage pack 30, it may be operated depending on the amount of stored in the storage pack 30, operating an operational switch 70 mounted under the storage pack in on and off states.

The operational switch 70 is operatively pressed in on and off states by pressing of the moving operational plate 60. The operational switch 70 is connected with the solenoid valve 50 of the ink supply tank and is opened and closed by the operation of the operational plate 60, thus controlling ink supply.

Accordingly, as shown in the drawings, in use, the cartridge 300 of the present invention is mounted to the cartridge assembly 200 of the large-scale printer in a state that it is connected with the ink supply tank 400 through the supplying tube 41.

The cartridge 300 is constructed in such a way that the storage pack 30 with a certain quantity of ink filled therein is installed inside the case 301, the operational plate 60 is, at one face of the storage pack, integrally attached to the adhesive face 33, and the operational switch 70 is placed at lower portion of the operational plate 70 inside the case 301.

Figure 7:
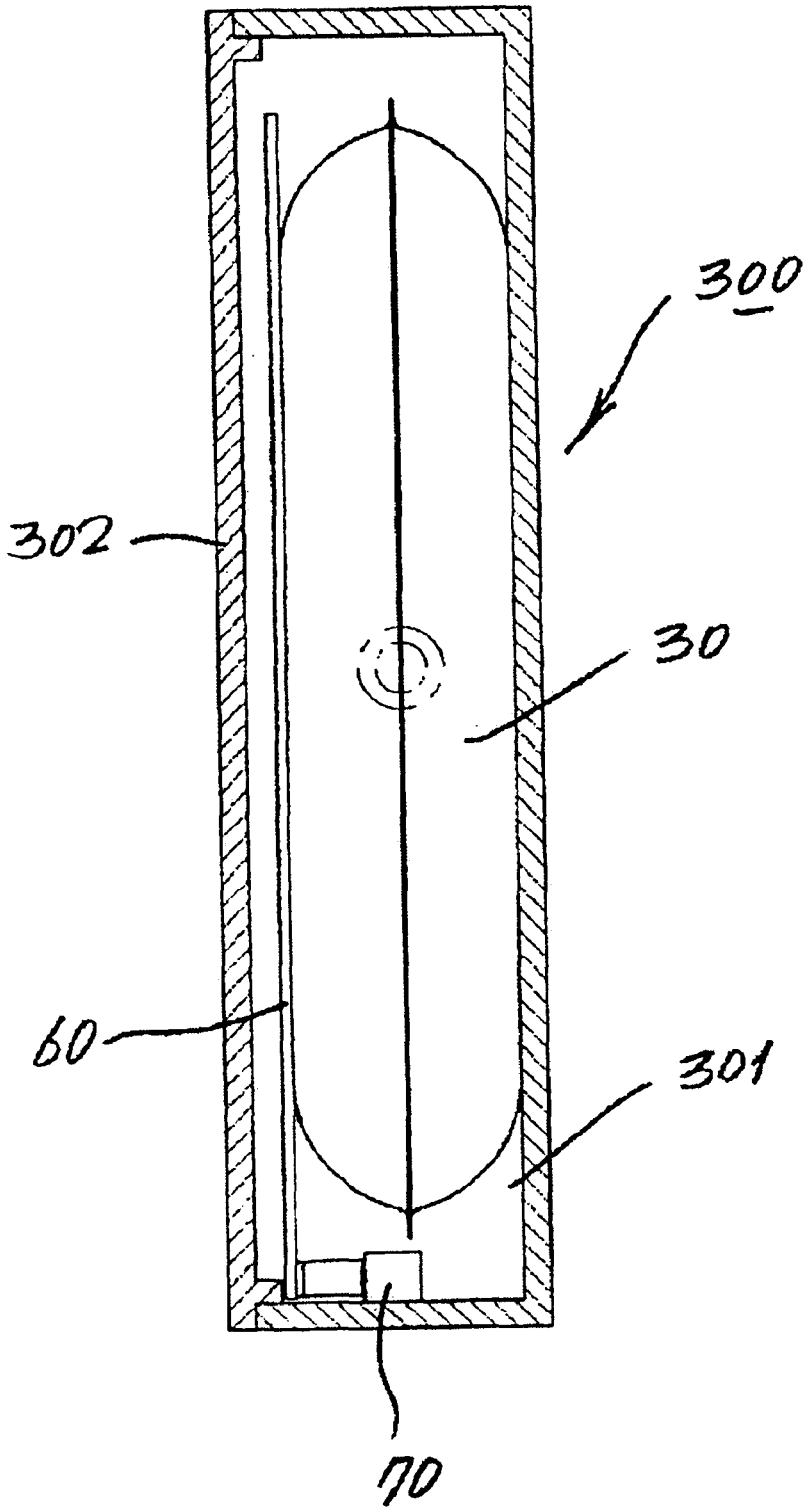
FIG. 7 is a side view of the cartridge of the present invention in a state that it is not yet operated.

As shown in FIG. 7, since the storage pack 30 is sufficiently filled with ink thus to maintain a swelled state, the operational plate 60 can be moved outwards to be spaced from the operational switch 70 so as to stand by the operation.

That is, the operational switch 70 is maintained in off state and the solenoid valve 50 of the ink supply tank 400 connected with the switch is also maintained in off state, thus maintaining the supplying tube 41 in off state.

In this state, since air is filled between the supplying pipe 42 of the supplying tube 41 and the solenoid valve 50, the air has to be removed from the portion so as not to be introduced into the storage pack 30 when the supplying tube 41 of the ink supply tank 400 is connected to the storage pack 30 of the cartridge 300.

To this end, upon initial setting, the ink supply tank 400 is placed below the storage pack 30 and then the supplying pipe 42 of the supplying tube 41 is inserted and connected to the ink inlet 32 of the storage pack 30 in a state that the solenoid valve 50 is opened.

Accordingly, ink in the storage pack 30 reversly flows in the ink supply tank 400 positioned below the storage pack through the supplying tube 41 so that remaining air in the supplying tube 41 is removed through the ink supply tank 400.

Then, in a state that air is completely removed, if the ink supply tank 400 is put on the shelf 401 positioned on the rear portion of the body 100, the ink supply tank 400 is maintained to be positioned higher than the storage pack 30 of the cartridge 300, so that ink may be supplied to the storage pack 30 due to potential energy by a head drop.

In this state, the cartridge 300 is inference-fitted to the slot 201 so that the syringe-needle type connecting pipe 202 in the slot 201 connected with the print head is inserted and connected to the ink outlet 31 of the storage pack 30.

Figure 8:
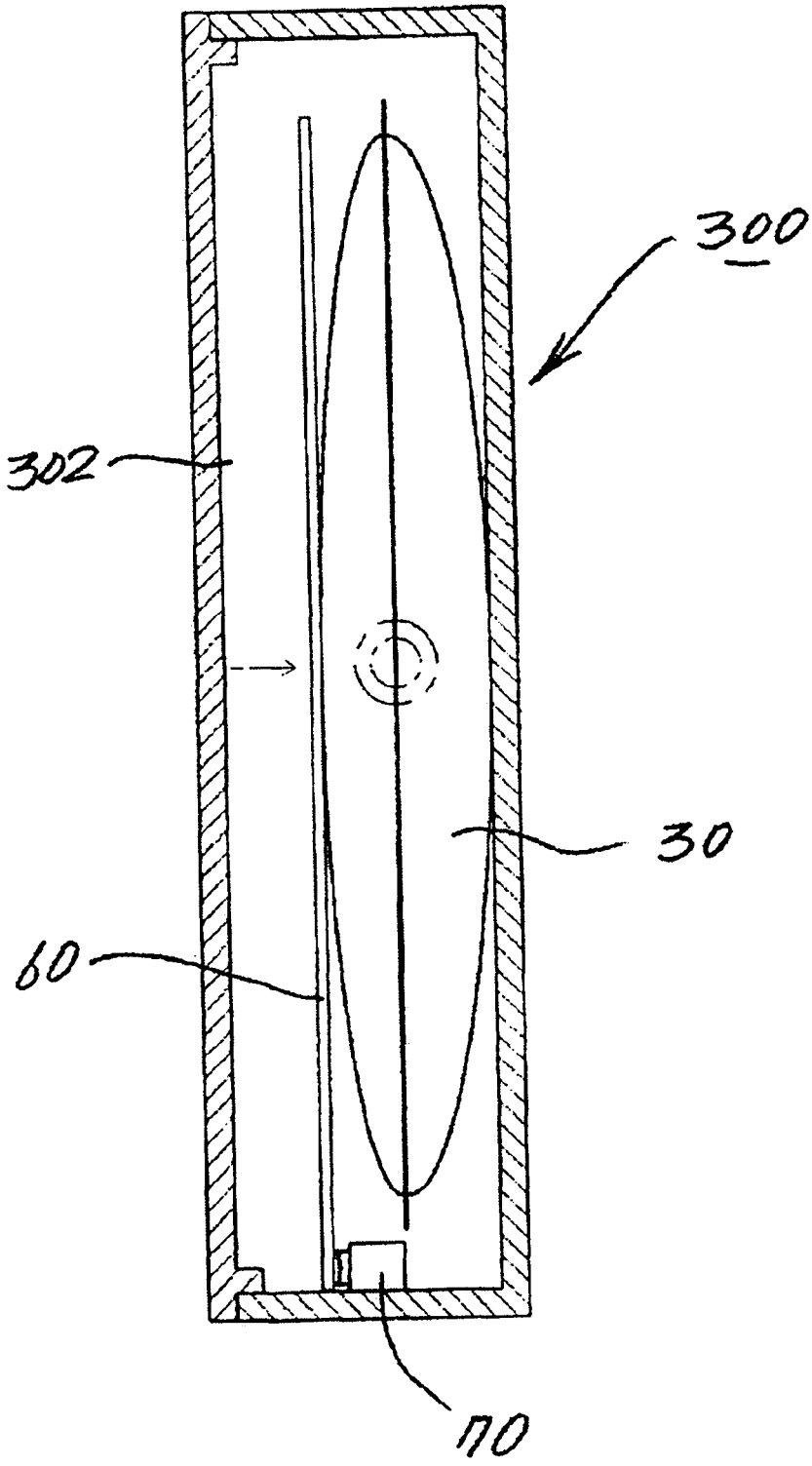
FIG. 8 is a side view of the cartridge of the present invention in a state that it is now operating.
Figure 9:
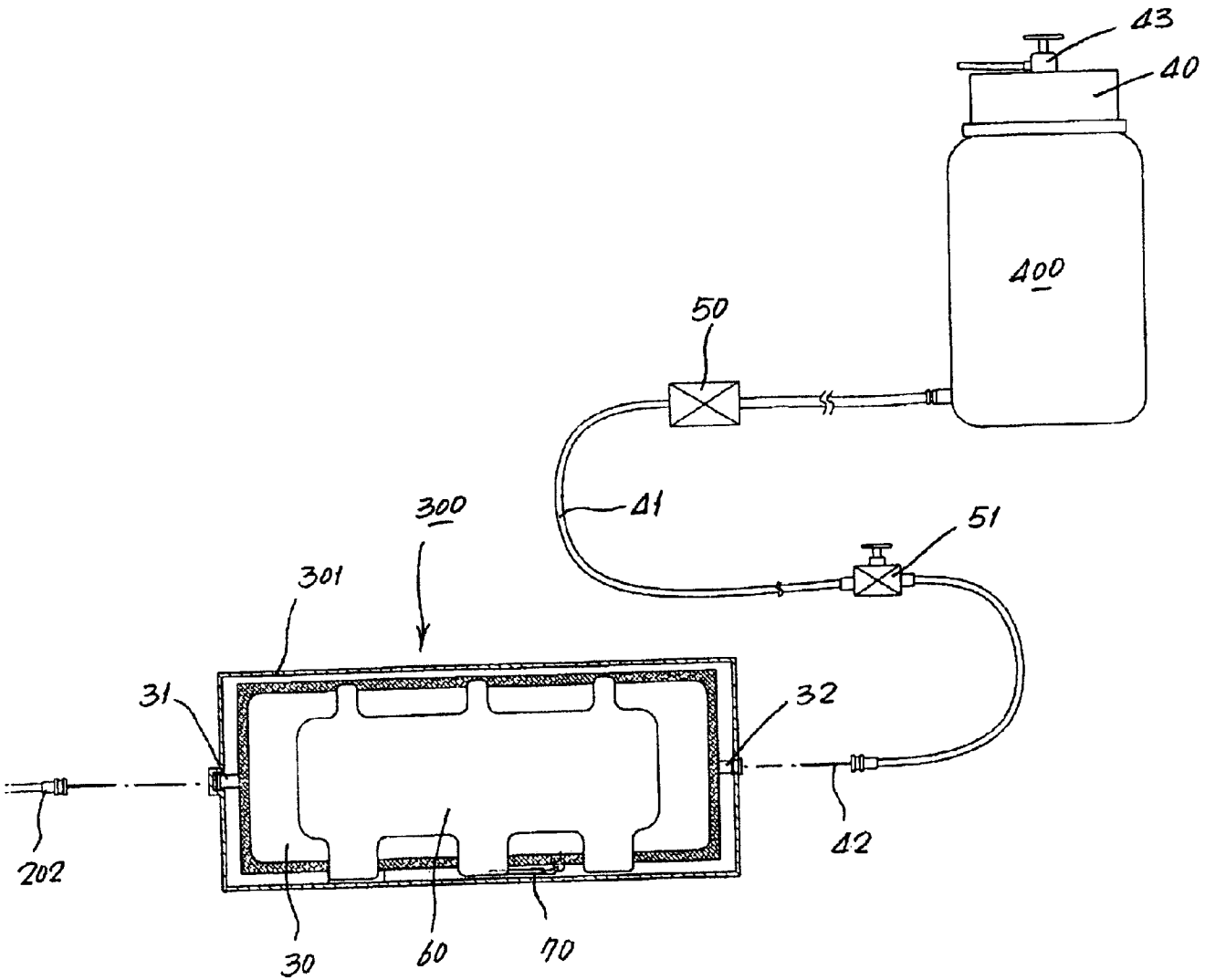
FIG. 9 is a constitutional view showing an another embodiment of the present invention.

When the cartridge assembly 200 of the present invention is completely assembled as is described above, the printer can be used like common printer, and when ink is consumed more than certain amounts, the storage pack 30 is contracted from a state shown in FIG. 7 to a state shown in FIG. 8.

That is to say, when the storage pack 30 is fully filled with the ink, the storage pack 30 is kept swelled. Then, the storage pack 30 is decreased in its volume in proportion to consumption of the ink. As a result, the operational plate 60, which is integrally attached to the surface of the storage pack 30, is moved to press down the operational switch 70, so that the operational switch 70 is turned on.

As the operational switch 70 is turned on, the solenoid valve 50 connected with the operational switch 70 is operated to open the supplying tube 41. Thus, the ink stored in the ink supply tank 400 is refilled into the storage pack 30 through the supplying tube 41 under the natural pressure.

Meanwhile, as mentioned above, both the air inflow control valve 43 provided on the cap 40 of the ink supply tank 400 and the control valve 51 provided on the supplying tube 41 are adjusted, so that a feed quantity of the ink can be freely adjusted.

In this manner, as the ink is refilled into the storage pack 30, the storage pack 30 returns its initial volume to be swelled as shown in FIG. 7. As a result, the operational plate 60 is moved into its initial position to turn off the operational switch 70, so that the solenoid valve 50 can block off the supplying tube 41.

Repetition of this operation allows the ink to be refilled into the storage pack 30 in a continuous and automatic manner in proportion to a consumption quantity by which the ink in the storage pack 30 is consumed. Here, the ink supply tank 400 must be always refilled with a proper quantity of ink.

To this end, the ink supply tank 400 is made from a transparent material so that it is possible to check with a naked eye whether or not the ink supply tank 400 is refilled with the ink. In addition, the ink supply tank 400 is provided with a separate sensing means so that it is possible to automatically check the same. As a result, the ink can be refilled if necessary.

Consequently, the concept of the present invention is not to supply the ink after it is completely consumed, but to refill a proper quantity of ink in a continuous and automatic manner at all times. Therefore, the present invention can be effectively applied to a large-scale printer.

INDUSTRIAL APPLICABILITY

As can seen from the foregoing, the present invention has a very economical construction in which the ink is continuously refilled into the cartridge of the large-scale printer, so that the expensive cartridge has no necessity to be exchanged and used and thus has almost complete exclusion of its waste.

Further, the present invention has the effects in that a problem in that a printing is interrupted due to consumption of ink during a printing operation, is eliminated so that it is expected to reduce printing time and to remove a factor of generation of defective products, securing reliability of a printer.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An ink supply apparatus for large-scale inkjet printer, the apparatus comprising:

a cartridge 300 having a storage pack 30, which is installed in a rectangular parallelepiped case 301, which contains ink, and which has, at front and rear ends, respectively, an ink outlet 31 and an ink inlet 32, respectively, the ink outlet and inlet being integrally formed to the storage pack, and an operational switch 70 which is installed on one side under the case, and which is operated in on and off states by an operational plate 60 integrally formed on a surface of one face of the storage pack 30;

an ink supply tank 400 storing a certain quantity of ink and connected with a supplying tube 41 through the ink inlet 32 of the storage pack 30 so as to continuously refill the storage pack 30 with ink by a head drop; and a solenoid valve 50 installed to the supplying tube 41 at proper position and connected with the operational switch 70 so as to open and close the supplying tube 41 using on/off operation of the operational switch.

2. The ink supply apparatus as claimed in claim 1, wherein the ink supply tank 400 is installed to a portion higher than that of at least storage pack 30 so that ink is supplied by the head drop.

3. The ink supply apparatus as claimed in claim 1, wherein an air inflow control member 43 is provided on a cap 40 of the ink supply tank 400 so that the inflow quantity of exterior air is freely adjusted to control the supplying quantity of ink.

4. The ink supply apparatus as claimed in claim 1, wherein a control valve 51 is provided to the supplying tube 41 so as to freely control the supplying quantity of ink.

* * * * *